US008495889B2

(12) United States Patent
Saunders et al.

(10) Patent No.: US 8,495,889 B2
(45) Date of Patent: Jul. 30, 2013

(54) RETAIL REFRIGERATION APPARATUS AND METHOD FOR INSTALLING THE SAME

(75) Inventors: Craig Saunders, Rocky River, OH (US); Jeffrey Kalman, Cleveland Heights, OH (US); David Boll, Avon, OH (US); Gary Robert Stephan, Seven Hills, OH (US); Lindsey Tufts, Jr., Eastlake, OH (US)

(73) Assignee: Bil-Jac, Inc., Medina, OH (US)

( * ) Notice: Subject to any disclaimer, the term of this patent is extended or adjusted under 35 U.S.C. 154(b) by 790 days.

(21) Appl. No.: 12/752,841

(22) Filed: Apr. 1, 2010

(65) Prior Publication Data

US 2011/0239676 A1 Oct. 6, 2011

(51) Int. Cl.
*A47F 3/04* (2006.01)

(52) U.S. Cl.
USPC ..... 62/251; 62/264

(58) Field of Classification Search
USPC ..... 62/251, 264, 449; 248/220.41, 250; 312/138.1
See application file for complete search history.

(56) References Cited

U.S. PATENT DOCUMENTS

| | | | | |
|---|---|---|---|---|
| 3,605,431 | A | 9/1971 | Carson | |
| 4,148,535 | A | 4/1979 | Fenwick | |
| 5,448,896 | A | 9/1995 | Rushing | |
| 5,499,513 | A | 3/1996 | Bustos | |
| 5,699,676 | A | 12/1997 | Trulaske, Sr. | |
| 6,189,707 | B1 * | 2/2001 | Meyers et al. | 211/90.04 |
| 6,406,108 | B1 | 6/2002 | Upton et al. | |
| 7,240,506 | B2 * | 7/2007 | Grassmuck et al. | 62/249 |
| 7,806,543 | B2 * | 10/2010 | Swofford et al. | 362/92 |
| 2002/0175132 | A1 * | 11/2002 | Shea | 211/87.01 |
| 2004/0227041 | A1 * | 11/2004 | Lewis | 248/220.41 |
| 2007/0236111 | A1 | 10/2007 | Gray | |

FOREIGN PATENT DOCUMENTS

| | | |
|---|---|---|
| GB | 2198030 | 6/1988 |

* cited by examiner

*Primary Examiner* — Melvin Jones
(74) *Attorney, Agent, or Firm* — Rankin, Hill & Clark LLP

(57) ABSTRACT

A refrigeration apparatus for mounting to a retail gondola includes a case, a door hingedly connected with the case, a compressor disposed within the case, a condenser coil disposed within the case, an evaporator coil disposed within the case, and brackets connected with the case. The case includes a top wall, a bottom wall, a left wall, a right wall and a rear wall defining a forward opening and a storage compartment for storing retail items. The case further includes a heat-conductive inner wall and a heat-conductive outer wall. The door is moveable between a closed position for covering the forward opening and an open position for providing access to the storage compartment. The condenser coil is disposed adjacent the outer wall and is in fluid communication with the compressor. The evaporator is disposed adjacent the inner wall and is in fluid communication with the compressor. The brackets extend rearwardly from the case away from the rear wall for engaging an upright of a retail gondola. A method for installing the refrigeration apparatus is also disclosed.

19 Claims, 5 Drawing Sheets

RETAIL REFRIGERATION APPARATUS AND METHOD FOR INSTALLING THE SAME

BACKGROUND

Retail stores that sell food, including pet food, are typically laid out to include an ambient-temperature dry food area and a refrigerated or freezer section, e.g., the frozen food section. Many foods, including pet foods, do not need to be frozen or refrigerated. Dry dog food and dog food treats are just one example of a pet food that is not refrigerated nor frozen. For human consumption, peanut butter, jelly and bread are other examples of food that are not typically refrigerated in a retail store.

Dog food, however, can also be sold refrigerated or frozen. Refrigerated or frozen dog food, however, is required to be located in the frozen food section. This section is typically located in another part of the store as compared to the ambient-temperature dry food area where typical dry dog food is displayed. Moreover, pre-made sandwiches including peanut butter, jelly and bread are also sold frozen; however, these pre-made sandwiches are also required to be displayed in the frozen food section of the retail store.

SUMMARY

A retail refrigeration apparatus and a method for installing a retail refrigeration apparatus that can allow frozen or refrigerated foods, including pet foods, to be sold adjacent dry foods will be described in more detail below. Such an apparatus allows the consumer a wider choice of options, e.g., frozen items, adjacent dry food items. Accordingly, the consumer can go to one location in the store to buy frozen items that are displayed along their dry or ambient-temperature counterparts.

A method for installing an in-line retail refrigeration apparatus includes placing the refrigeration apparatus onto a shelf of a retail gondola, inserting a hook feature of a bracket into an opening in an upright of the retail gondola, aligning an elongate slot formed in the bracket with a substantially circular opening in a case of the refrigeration apparatus, and inserting a fastener through the elongate slot and into the opening to attach the bracket to the case. When aligning the elongate slot formed in the bracket with the substantially circular opening in the case, the hook feature of the bracket engages the upright to limit movement of the bracket away from the upright, thus limiting movement of the case with respect to the retail gondola.

Inserting the hook feature of the bracket into the opening in the upright of the retail gondola can include inserting a hook feature of an upper bracket into a first opening in the upright. The method can further include inserting a hook feature of a lower bracket on a same side of the case into a second opening in the upright. The hook features for each respective bracket can extend in opposite directions.

The aforementioned method can further include positioning a power cord for the refrigeration apparatus in a power cord channel formed by the refrigeration apparatus. The method can further include pushing the refrigeration apparatus rearwardly to contact the upright of the retail gondola, wherein the power cord is offset from the upright. Such a configuration can maximize the capacity of the refrigeration apparatus to allow for more storage of a refrigerated product within the apparatus.

Aligning the elongate slot formed in the bracket with the substantially circular opening in the case can include contacting a sidewall of the case with the bracket. Aligning the elongate slot can further include sliding the bracket vertically such that the hook feature engages the upright to limit movement of the bracket away from the upright. Such a unique bracket shape and flexible attachment to the case of the refrigeration apparatus allows the refrigeration apparatus to be easily and securely mounted to varying gondola support details from various retail gondola manufacturers. Placing the refrigeration apparatus onto the shelf of the retail gondola can include positioning the case between a left upright and a right upright of the retail gondola such that the case nearly spans between the left upright and the right upright. For example, the horizontal space in between the left upright and the right upright of a typical retail gondola is about 48 inches. Accordingly, the case can have a horizontal dimension that is slightly less than 48 inches, which can maximize the capacity of the refrigeration apparatus. The aforementioned bracket can include a plate and hook features can extend rearwardly from the plate. The method for installing the in-line retail refrigeration apparatus can further include contacting a left sidewall and a right sidewall of the case with a respective bracket prior to inserting hook features of each bracket into a respective opening in the upright. Additionally, inserting the hook feature of the bracket into the opening in the upright of the retail gondola can be performed after placing the refrigeration apparatus onto the shelf of the retail gondola. If desired, however, the refrigeration apparatus can be mounted directly to the upright without being supported by the shelf of the retail gondola.

The method for installing the in-line retail refrigeration apparatus can further include illuminating a glass window of the case to present an image on the window indicative of a source of products located in the refrigeration apparatus.

The refrigeration apparatus can also include a decal on an inner rear wall thereof. Placing the refrigeration apparatus onto the shelf of the retail gondola can include positioning the case such that images on the decal align with at least one shelf in the case such that when the case is depleted of retail products, the images on the decal provide an appearance that retail products are located within the case.

An example of a refrigeration apparatus for mounting to a retail gondola includes a case, a door hingedly connected with the case, a compressor disposed within the case, a condenser coil disposed within the case, an evaporator coil disposed within the case, and brackets connected with the case. The case includes a top wall, a bottom wall, a left wall, a right wall and a rear wall defining a forward opening and a storage compartment for storing retail items. The case further includes a heat-conductive inner wall and a heat-conductive outer wall. The door is moveable between a closed position for covering the forward opening and an open position for providing access to the storage compartment. The condenser coil is disposed adjacent the outer wall and is in fluid communication with the compressor. The evaporator is disposed adjacent the inner wall and is in fluid communication with the compressor. The brackets extend rearwardly from the case away from the rear wall for engaging an upright of a retail gondola.

Each bracket can include hook features extending from a plate. The brackets on a same side of the case can have upwardly extending hook features on one bracket and downwardly extending hook features on another bracket. Each bracket can include a slot elongated in a vertical direction, which is generally parallel with the rear wall. The refrigeration apparatus can also include a threaded fastener connecting the bracket with the case. The case can include an opening configured to receive the threaded fastener and the elongate slot can have a horizontal dimension configured to receive the threaded fastener for attaching the bracket to the case. The horizontal dimension can measure one and one half to two times the diameter of the opening in the case, which can allow for variations of an angle between the upright of the retail gondola and the shelf of the retail gondola. A lowermost opening in the case for receiving a threaded fastener can be disposed above a vertical midpoint of the left wall or the right wall.

The refrigeration apparatus can also include a power cord electrically connected with the compressor and a support base connected with and contacting the bottom wall of the case. The support base can be inwardly offset from the rear wall for defining a power cord channel for receiving the power cord. The power cord channel can extend from the left side wall to the right side wall and can be less than two inches in height. Such a configuration can maximize the capacity of the refrigeration apparatus.

The door of the refrigeration apparatus can include a frame, a window mounted to the frame, a linear light source mounted to the frame, and a refractive element on the window. The light source and the refractive element can be positioned to cooperate such that light emanating from the light source contacts the refractive element and is directed forwardly for presenting an image on the window to a consumer viewing the refrigeration apparatus. An example of such a linear light source can be a string of LEDs.

The refrigeration apparatus can further include at least one shelf mounted to the case inside the storage compartment and a decal affixed to the inner wall on the rear wall of the case. The decal can include at least one image of a product that is stored in the storage compartment. The at least one image can be aligned so as to appear as the image is supported on the at least one shelf. If desired, an image can simply be provided on the inner wall on the rear wall of the case. Such an image can depict a product that is stored in the storage compartment and the image can be aligned so as to appear as the image is supported on the at least one shelf mounted to the case inside the storage compartment.

DETAILED DESCRIPTION

Figure 1:
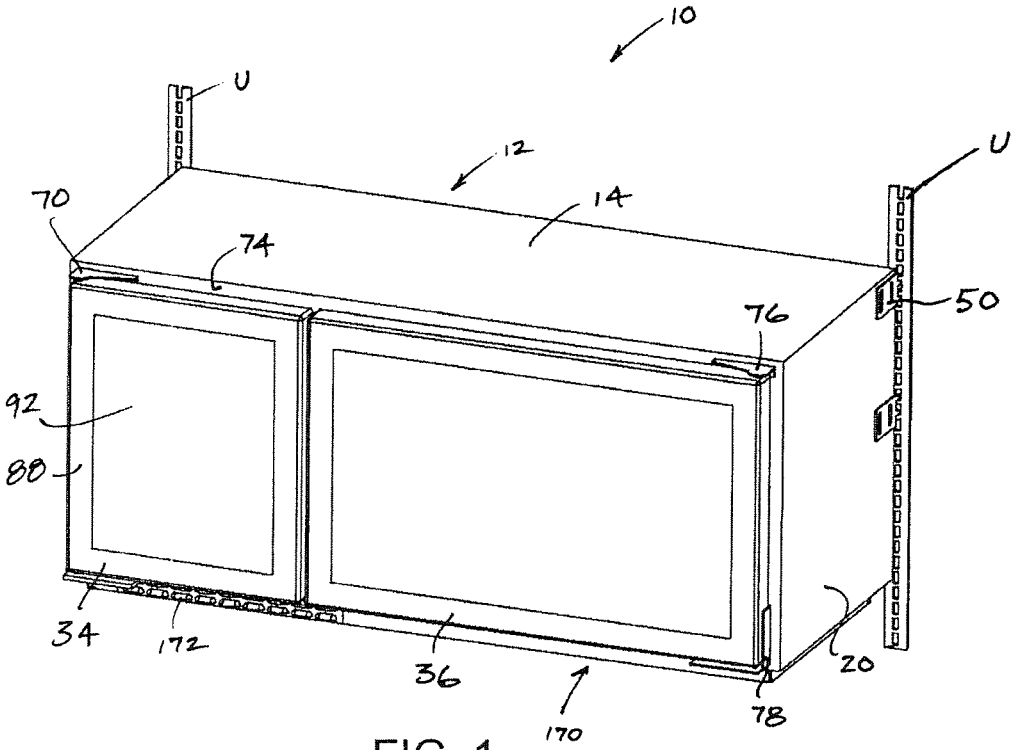
FIG. 1 is front perspective view of a retail refrigeration apparatus.
Figure 2:
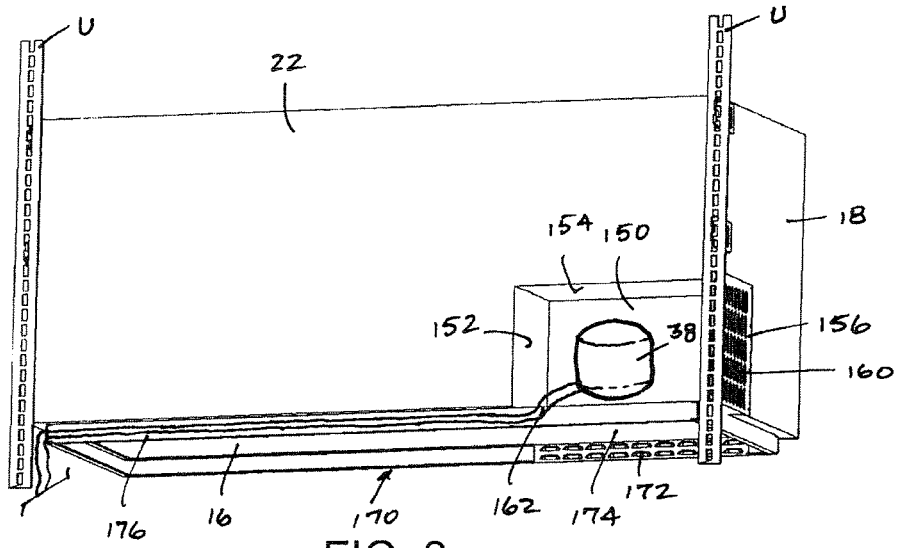
FIG. 2 is a rear perspective view of the refrigeration apparatus shown in FIG. 1 with a rear cover plate removed.
Figure 3:
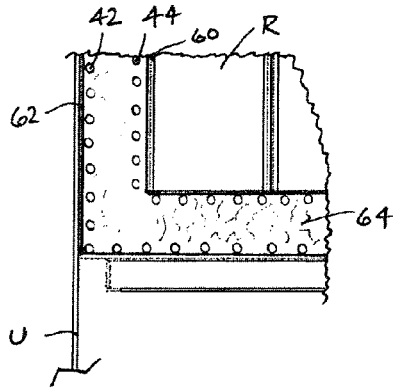
FIG. 3 is a cross-sectional view taken through a lower left corner of the retail refrigeration apparatus.
Figure 4:
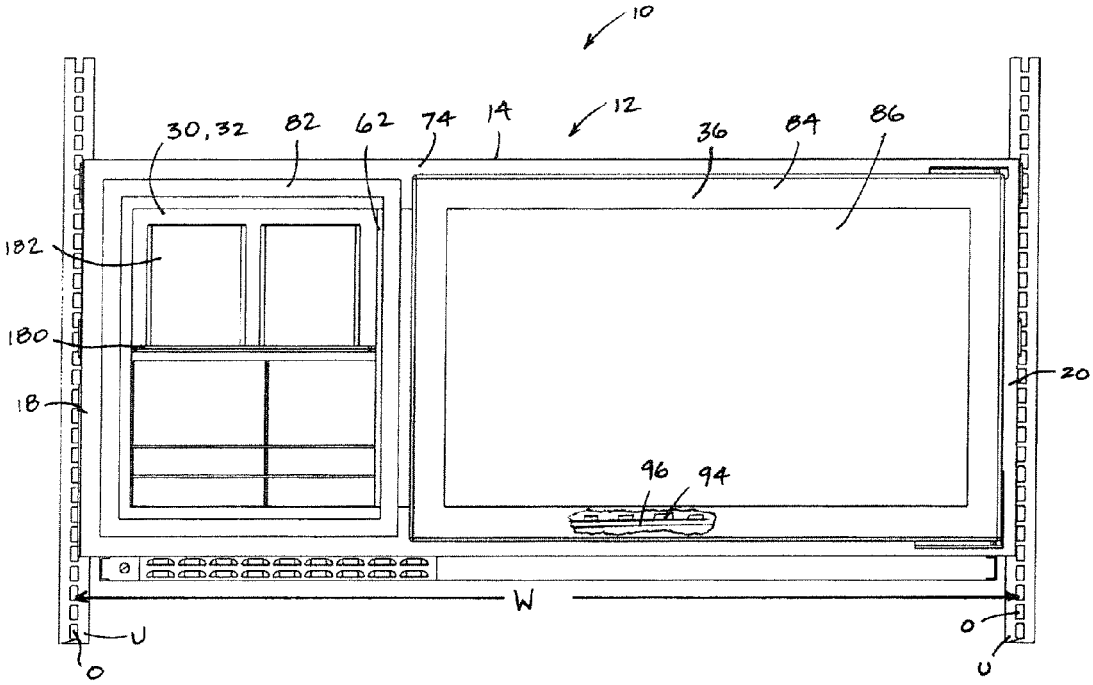
FIG. 4 is a front elevation view of the retail refrigeration apparatus of FIG. 1 with a left door removed and portions broken away from the right door to show a light source mounted within the door.

FIG. 1 depicts a refrigeration apparatus 10 for mounting to a retail gondola. In FIG. 1 only uprights U of the gondola are depicted. Shelves, such as the shelf S depicted in FIG. 8, also make up the retail gondola. With reference back to FIGS. 1 and 2, the refrigeration apparatus 10 includes a case 12 including a top wall 14, a bottom wall 16, a left wall 18, a right wall 20, and a rear wall 22. With reference to FIG. 4, the top wall 14, the bottom wall 16, the left wall 18, the right wall 20 and the rear wall 22 define a forward opening 30 and a storage compartment 32 for storing frozen or refrigerated retail items R (FIG. 3) within the storage compartment. With reference back to FIG. 1, a door, which in the depicted embodiment includes a left smaller door 34 and a right larger door 36, hingedly connects with the case 12. Each door is moveable between a closed position, which is shown in FIG. 1, covering the forward opening 30 and an open position (not shown) for providing access to the storage compartment 32. With reference to FIG. 2, a compressor 38 (depicted schematically) is disposed within the case 12. With reference to FIG. 3, a condenser coil 42 is also disposed within the case 12 and is in fluid communication with the compressor 38. With continued reference to FIG. 3, an evaporator coil 44 is also disposed within the case 12 and is in fluid communication with the compressor. An expansion valve (not depicted) is also disposed within the case so that the compressor 38, the condenser coil 42, and the evaporator coil 44, along with the expansion valve, form a refrigeration circuit for drawing heat away from the products R disposed within the storage compartment 32 (FIG. 3). With reference back to FIG. 1, brackets 50 connect with the case 10 and extend rearwardly from the case away from the rear wall 22 for engaging the uprights U of the retail gondola.

Figure 5:
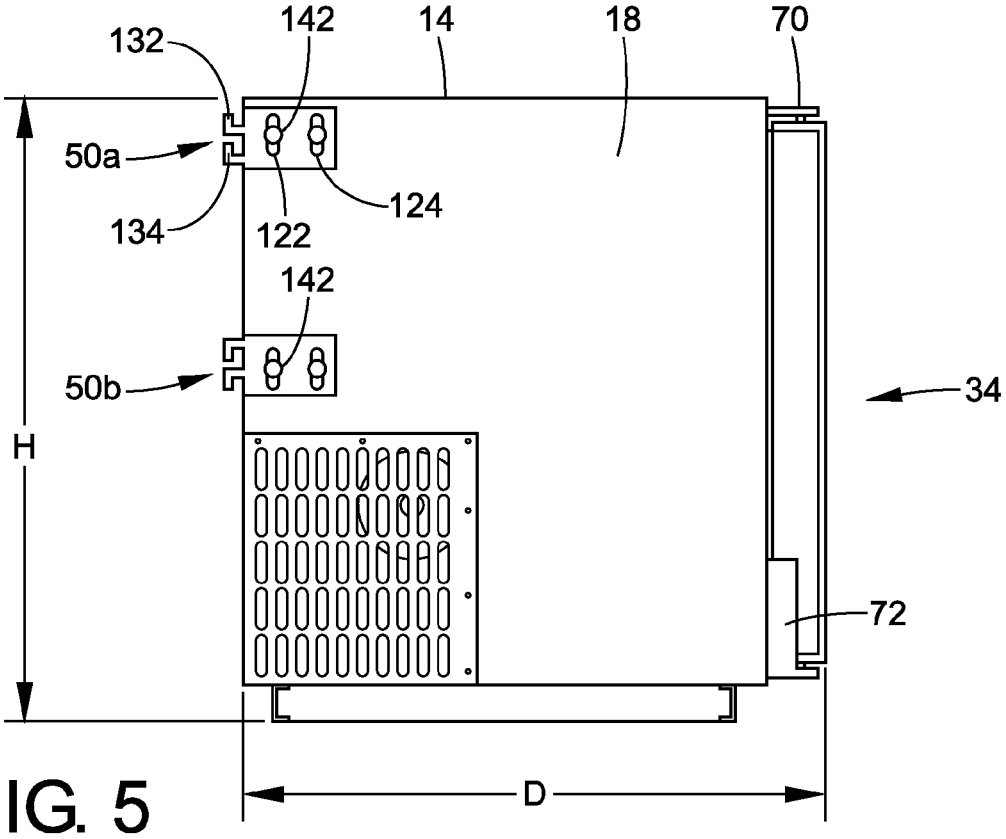
FIG. 5 is a side elevation view of the refrigeration apparatus depicted in FIG. 1.

As mentioned above, the case 12 of the refrigeration apparatus 10 includes the top wall 14, the bottom wall 16, the left wall 18, the right wall 20, and the rear wall 22. The case 12 can be dimensioned so that it is able to fit "in-line" with standard retail shelving; thus the refrigeration apparatus can be referred to as an in-line retail refrigeration apparatus. The refrigeration apparatus 10 can have a capacity that can be adjusted depending upon a particular retail application. With reference to FIG. 4, the case 12 can have a horizontal dimension W that is slightly less than about 48 inches, which is not longer than the typical horizontal spacing between adjacent openings O found between adjacent vertical uprights U on a retail gondola. Nevertheless, should the typical space in between vertical uprights U change, the horizontal dimension W of the case 12 could also change. With reference to FIG. 5, the case 12 and the accompanying doors 34, 36, can have horizontal dimension, or depth D, of less than about 20 inches, which is typically about the same as or slightly longer than the typical depth of a retail shelf S (FIG. 8) for a typical retail gondola. Moreover, the case 12 can also have a vertical dimension, or height space H, less than about 21.5 inches, which is typically a few inches shorter than the typical vertical space in between adjacent shelves of a typical retail gondola. These dimensions maximize the capacity of the storage compartment 32 of the refrigeration apparatus 10 while allowing the refrigeration apparatus to engage the vertical uprights U of a typical retail gondola. The case 12 is depicted as generally box-like in shape; however, the case could take other configurations.

With reference back to FIG. 3, the case also includes a heat conductive inner wall 60 and a heat conductive outer wall 62. The inner wall 60 and the outer wall 62 can each form a component of the top wall 14, the bottom wall 16, the left wall 18, the right wall 20 and the rear wall 22. In the illustrated embodiment, the refrigeration apparatus is depicted as a "cold wall freezer" such that forced air (or a fan) is not required for cooling products R within the storage compartment 32. In the illustrated embodiment, the inner wall 60 is formed of aluminum and the outer wall 62 is formed of steel. Insulating material 64 can be interposed between the inner wall 60 and the outer wall 62. With continued reference to FIG. 3, the condenser coil 42 disposed within the case 12 is disposed adjacent the outer wall 62 and the evaporator coil 44 disposed within the case 12 is disposed adjacent the inner wall 60. The insulating material 64 prevents thermal communication between the condenser coil 42 and the evaporator coil 44. Accordingly, the condenser coil 42 is in thermal communication with the outer wall 62 and the evaporator coil 44 is in thermal communication with the inner wall 60.

With reference to FIG. 4, the refrigeration apparatus 10 also includes a vertical internal wall 66 disposed within the storage compartment 32 of the case 12. The internal wall 66 can divide the storage compartment 32 into separate storage compartments each amenable for receiving products R of differing sizes.

With reference back to FIG. 1, as mentioned above the left door 34 and the right door 36 hingedly attach with the case 12. In the illustrated embodiment, a left upper hinge bracket 70 and a left lower hinge bracket 72 (FIG. 5) each mount to a front surface 74 of the case 12. The left door 34 attaches to the brackets 70 and 72, which attach to the case 12 for hingedly attaching the left door to the case. Similarly, a right upper bracket 76 and a right lower bracket 70 also attach to the front surface 74 for hingedly connecting the right door 36 to the case 12. The left door 34 is shown smaller than the right door 36; however, the doors can be similarly shaped and/or only one door or a greater number of doors could be provided. Additionally, each of the doors 34, 36 are shown to rotate about a generally vertical axis; however, the doors can be attached in a manner such that the doors rotate about a generally horizontal axis. With reference to FIG. 4, a gasket 82 is shown mounted on the front surface 74 for cooperation with the left door 34. A similar gasket (not visible) can be provided on the front surface 74 for cooperation with the right door 36.

With continued reference to FIG. 4, the right door 36 includes a frame 84, which is opaque, and a window 86 mounted to the frame. In the illustrated embodiment, the frame 84 is made from metal; however, the frame could be made from another rigid material. The window 86 is made from a translucent and/or transparent material, such as plastic or glass. The window 86 can allow a consumer to view the contents stored within the refrigeration apparatus 10. With reference back to FIG. 1, the left door 36 can also include a similar frame 88 and a similar window 92. Each frame 84 and 86 and each window 86 and 92 are generally rectangular in configuration. Other configurations could be provided.

Figure 6:
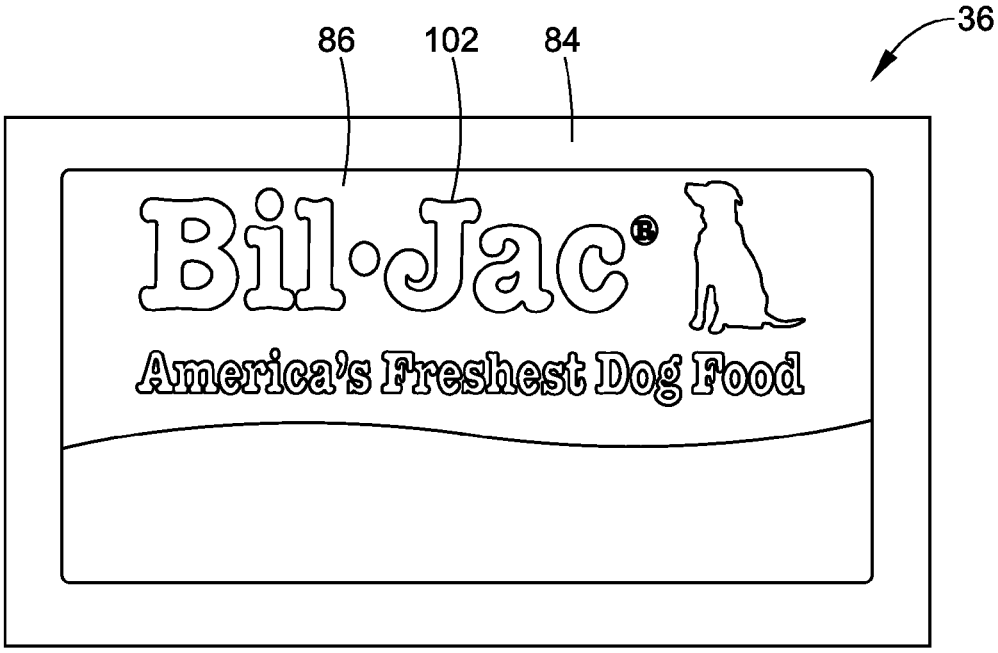
FIG. 6 is a front elevation view of the right door of the refrigeration apparatus shown in FIG. 1 depicting reflective material attached to a glass window of the door illuminated to present an image on the window.

With reference back to FIG. 4, the right door 36 can also include a light source, for example a plurality of light emitting diodes ("LEDs") 94, mounted on a printed circuit board 96. The printed circuit board 96 can extend in a horizontal direction parallel with the width W of the case 12 and the LEDs can be spaced along the printed circuit board; therefore, this light source can be considered as a linear light source. Another linear light source, for example a fluorescent tube or a plurality of incandescent light bulbs, could also be provided. The LEDs 94 are disposed below an upper edge of a lower portion of the frame 84 so as not to be visible by the consumer when viewing the products disposed within the case 12. With reference to FIG. 6, the right door 36 can also include refractive or a reflective element 102 on the window 86. With reference to FIGS. 4 and 6, the light source 94 and the element 102 can be positioned to cooperate such that light emanating from the light source contacts the element 102 and is directed forwardly for presenting an image on the window 86. The image can provide a source identifier for the products located within the case 12. The element 102 is shown only on the right door 36; however, a similar light source and a similar reflective material can also be provided with the left door 34. In one embodiment, the element 102 can be formed by removing material from the window 86, which can include two layers of acrylic sheets, where the material is removed from one of the layers of sheets. Light can refract off of the removed material, which can be shaped as the image that can provide a source identifier for the products located within the case 12.

Figure 7:
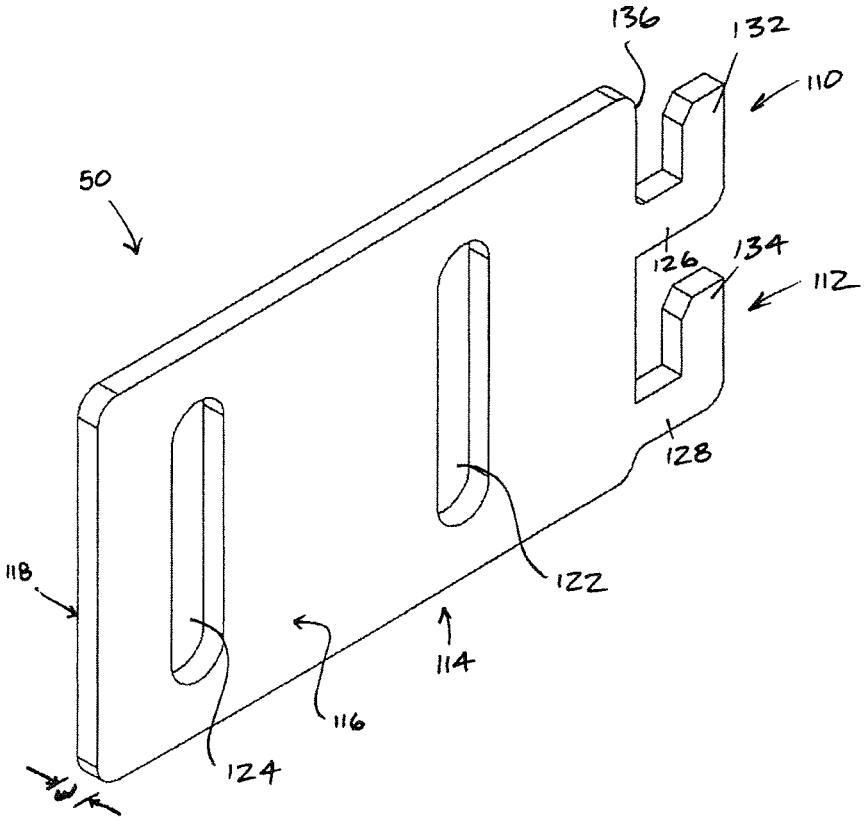
FIG. 7 is a perspective view of a bracket for the refrigeration apparatus shown in FIG. 1.

With reference back to FIG. 1, as discussed above brackets 50 are connected with the case 12 and extend rearwardly from the case away from the rear wall 22 for engaging with upright U of a retail gondola. In the illustrated embodiment, two brackets 50 are located on each side of the case 12 for mounting the case to the gondola. With reference to FIG. 5, an upper left bracket 50*a* attaches to the left side wall 18 of the case 12 adjacent the top wall 14 and a lower left bracket 50*b* attaches to the left wall 18 below the upper bracket. Each bracket is similarly configured; therefore, the brackets 50 will be described with reference to FIG. 7 with an understanding that the remaining brackets take a similar configuration. Each bracket 50 includes hook features, e.g., a first hook feature 110 and a second hook feature 112 extending from a plate 114. The plate 114 and the accompanying hook features 110 and 112 are made from a stamped sheet of metal having a relatively thin width w, which can be about or less than one-half inch. The plate 114 has a planar first surface 116 and a planar second surface 118. Each bracket 50 also includes an elongate slot, e.g., a first elongate slot 122 and a second elongate slot 124, which are each elongated in a vertical direction, which is generally parallel with the rear wall 22.

Each hook feature includes a connecting leg 126, 128, respectively, and an extending leg 132, 134, respectively. Each connecting leg 126, 128 extends from a rear peripheral edge 136 of the plate 114 in a rearward direction when in a configuration to engage the upright U (FIG. 1) of a retail gondola. Each hook feature 110, 112 also includes an extending leg 132, 134, respectively, which extend at a right angle to the respective connecting leg 126, 128 and generally parallel to the rear edge 136 of the plate 114.

With reference back to FIG. 5, the brackets 50*a* and 50*b* on the same side of the case 12 have upwardly extending hook features on one bracket, e.g., the upper bracket 50*a*, and downwardly extending hook features on another bracket, e.g., the lower bracket 50*b*. Upwardly extending hook features refer to the extending legs 132, 134 projecting upwardly from the respective connecting legs 126 and 128. Downwardly extending hook features refer to the extending legs 132, 134 extending downwardly from the respective connecting legs 126, 128. When the respective brackets 50 are connected to the upright U of the retail gondola, having the upwardly extending hook features and the downwardly extending hook features precludes vertical movement of the refrigeration apparatus 10 with respect to the retail gondola.

Figure 11:
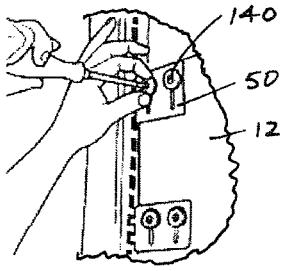

With reference to FIG. 11, the refrigeration apparatus 10 also includes a threaded fastener 140 connecting the brackets 50 with the case 12. As more clearly seen in FIG. 5, the case 12 includes a generally circular opening 142 (four are shown in FIG. 5, and four similar openings will be located on an opposite side of the case) configured to receive the threaded fasteners 140. The threaded fasteners 140 are inserted through the elongate slots 122, 124 and are received in the generally circular openings 142 for attaching the brackets 50 to the case. Each elongate slot 122, 124 has a horizontal dimension configured to receive the threaded fastener 140 for attaching the bracket 50 to the case 12. It can be desirable to provide each elongate slot 122, 124 to have a horizontal dimension about one and one-half times or two times the diameter of the generally circular opening 142 to allow for variation of an angle between the upright U and the shelf S (see FIG. 8). In a typical retail gondola, the shelf S is disposed at an angle that is slightly less than perpendicular with respect to the upright U to prevent the shelf from sagging under load. By providing the horizontal dimension in the elongate slots 122, 124 to be slightly larger than the diameter of the generally circular opening 142 in the case 12, which are located on the left wall 18 and the right wall 20, a greater tolerance is allowed for attaching the brackets 50 to the case 12.

With reference back to FIG. 5, a lower most opening 142 in the case 12 for receiving the threaded fastener 140 is disposed at or above a vertical midpoint of the left wall 18 or the right wall 20. Such a configuration can counteract a downward force applied to the doors 34, 36 when a consumer opens the doors to remove products R (FIG. 3) from the storage compartment 32.

With reference back to FIG. 2, the compressor 38 is disposed within the case 12. The case 12 is formed to include a compressor compartment 150 that is separated from the storage compartment 32 (FIG. 4) by an upright wall 152 and a generally horizontal wall 154. The compressor compartment 150 is covered by a left cover plate 156, which is generally coplanar with an exterior surface of the left wall 18, and a rear cover plate (not shown). Each cover plate includes openings 160 through which air can be drawn to cool the compressor 38.

In the illustrated embodiment, the compressor 38 includes a motor (not shown) that is driven by electrical current received from a wall outlet (not shown) via a power cord 162. This power cord 162 can also provide electrical power to the linear light source 94, where conditioning electronics may be provided.

The refrigeration apparatus further includes a support base 170 connected with and contacting the bottom wall 16 of the case 12. The support base 170 can be made from a plurality of metal channels formed in a rectangular configuration. The support base 170 has a small, e.g., less than one inch, height (vertical dimension) as compared to the height H of the refrigeration apparatus. This can maximize the storage capacity of the storage compartment 32 (FIG. 3). Vent openings 172 can be located on a left side of the refrigeration apparatus 10 to provide a pathway for air to flow through openings (not visible) in a bottom wall 174 of the compressor compartment 150 for cooling the compressor 38. In the illustrated embodiment, the right most vent opening is disposed less than midway (horizontally) across the front surface of the support base 170. Since the refrigeration apparatus 10 is a "cold wall" freezer, vent openings across the entire support base 170 are not necessary to provide adequate air flow for cooling the compressor 38. With reference to FIG. 5, the support base 170 is inwardly offset from the rear wall 22 for defining a power cord channel 176 for receiving the power cord 162. The power cord channel 176 can extend from the left side wall 18 to the right side wall 20 and can be less than two inches in height. Again, such a small configuration can maximize the storage capacity of the storage compartment 32 (FIG. 3) of the refrigeration apparatus 10. The support base 170 can contact an upper surface of a shelf S of the gondola and legs are not necessary for clearance to provide air flow to cool the compressor 38 since the vent openings 172 are provided.

With reference to FIG. 4, the refrigeration apparatus 10 can also include at least one shelf 180 mounted to the case 12 inside the storage compartment 32. The shelf 180 can be provided for supporting products R disposed within the storage compartment. Even though only one shelf 180 is shown in FIG. 4, another shelf can be disposed behind the right door 36. The refrigeration apparatus 10 can also include a decal 182 affixed to the inner rear wall 60 (FIG. 3) on the rear wall 22 (FIG. 2) of the case 12. The decal 182 can include at least one image of a product that is stored within the storage compartment 32. The at least one image can be aligned with the shelf 182 so as to appear as the image is supported on the shelf when the storage compartment 32 is depleted of products. Accordingly, even if a portion of the storage compartment 32 is depleted of products, valuable advertising space is being provided inside the storage compartment. Alternatively, simply an image can be provided on the inner wall on the rear wall of the case 12. Similarly the image depicts a product that is stored in the storage compartment 32 and the image would be aligned so as to appear as the image is supported on the at least one shelf.

Figure 8:
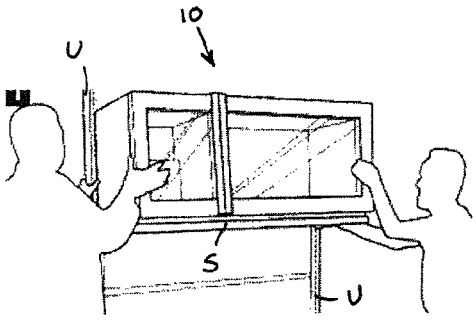
FIGS. 8-11 are schematic depictions representing a method for installing the retail refrigeration apparatus depicted in FIG. 1.
Figure 9:
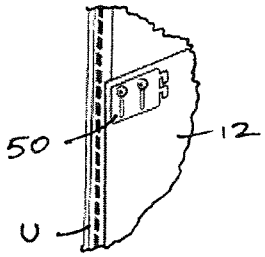
Figure 10:
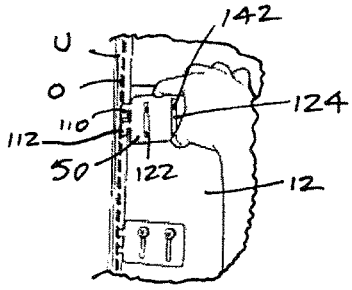

A method for installing an in-line retail refrigeration apparatus, such as the apparatus depicted in FIG. 1, will be further described with reference to FIGS. 8-11. With reference to FIG. 8, the method includes placing the refrigeration apparatus 10 onto a shelf S of a retail gondola. With reference to FIG. 9, the brackets 50 can be removed from the case 12. As shown in FIG. 9, the brackets 50 are attached to the case in a shipping mode where the hook features face forwardly, as opposed to rearwardly. Accordingly, a person installing the refrigeration apparatus 10 would remove the brackets 50 from the case 12. The method further includes inserting a hook feature 110, 112 of the bracket 50 into an opening O in an upright U of the retail gondola. The method can further include aligning an elongate slot 122, 124 formed in the bracket 50 with the substantially circular opening 142 in the case 12 of the refrigeration apparatus. The elongate slots 122, 124 are aligned such that the hook features 110, 112 engage the upright U to limit movement of the bracket 50 away from the upright. This is depicted in FIG. 10. With reference to FIG. 11, the method further includes inserting the fastener 140 through the elongate slots 122, 124 and into the openings 142 in the case 12 to attach the bracket(s) 50 to the case 12.

Inserting the hook features 110, 112 of the bracket 50 can include inserting a hook feature of an upper bracket, e.g. the upper bracket 50*a* depicted in FIG. 5, and on a same side of the case inserting a hook feature 110, 112 of a lower bracket, e.g. lower bracket 50*b*, into a second opening in the upright U where the hook feature for each respective bracket extends in opposite directions, such as that shown in FIG. 5.

The method can further include positioning the power cord 162 for the refrigeration apparatus 10 in the power cord channel 174 formed by the refrigeration apparatus 10. The method could further include pushing the refrigeration apparatus 10 rearwardly to contact the upright U. After pushing the refrigeration apparatus 10 rearwardly to contact the upright, the power cord 162 remains offset from the upright U. Accordingly, the depth of the refrigeration apparatus 10 can be maximized.

Aligning the elongate slots 122, 124 can include contacting a side wall, e.g., the left wall 18 or the right wall 20, of the case 12 with the brackets and sliding the brackets vertically such that the hook features engage the upright to limit movement of the bracket away from the upright. If desired, inserting the hook feature of the bracket 50 into the opening O in the upright U of the retail gondola can be performed after placing the refrigeration apparatus onto the shelf of the retail gondola. Engaging the brackets 50 with the upright of the retail gondola limits movement of the refrigeration apparatus 10 away from the gondola, especially when a downward force is applied on the doors 34, 36 by a consumer opening the doors of the refrigeration apparatus.

Placing the refrigeration apparatus onto the shelf of the retail gondola can include positioning the case 12 between a left upright and a right upright of the retail gondola such that the case 12 nearly spans between the left upright and the right upright. As discussed above, the bracket 50 includes the plate 116 and the hook features 110, 120 extending rearwardly from the plate when the bracket is aligned to engage the upright. The method can further include contacting the left side wall 18 and the right side wall 20 of the case with the respective brackets 50 prior to inserting the hook features 110, 112 of each bracket 50 into a respective opening O in the uprights.

The method can further include illuminating the element 102 attached to the window 86 of the case 12. The element 102, when illuminated or contacted by light from the light source 94, presents an image on the window 86 indicative of a source of products located within the refrigeration apparatus. As discussed above, the refrigeration apparatus 10 can also includes a decal 182 (or simply an image) on an inner rear wall thereof. Placing the refrigeration apparatus 10 onto the shelf S of the retail gondola can include positioning the case 12 such that the images on the decal align with at least one shelf in the case such that when the case is depleted of retail products, the images on the decal (or the images themselves) provide an appearance that retail products are located within the case.

The refrigeration apparatus and a method for installing an in-line retail refrigeration apparatus have been described with particularity. Modifications and alterations will occur to those upon reading and understanding the preceding detailed description. The appended claims are not limited to only the embodiments described above, instead, the appended claims are to be broadly construed to include all equivalent structures, even those structures not particularly described above.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for installing an in-line retail refrigeration apparatus comprising:

placing a refrigeration apparatus onto a shelf of a retail gondola;

inserting a hook feature of a bracket into an opening in an upright of the retail gondola;

aligning an elongate slot formed in the bracket with a substantially circular opening in a case of the refrigeration apparatus such that the hook feature engages the upright to limit movement of the bracket away from the upright; and inserting a fastener through the elongate slot and into the opening to attach the bracket to the case.

2. The method of claim 1, wherein inserting the hook feature of the bracket includes inserting a hook feature of an upper bracket into a first opening in the upright and on a same side of the case inserting a hook feature of a lower bracket into a second opening in the upright wherein the hook feature for each respective bracket extends in opposite directions.

3. The method of claim 1, further comprising:

positioning a power cord for the refrigeration apparatus in a power cord channel formed by the refrigeration apparatus; and pushing the refrigeration apparatus rearwardly to contact the upright, wherein the power cord is offset from the upright.

4. The method of claim 1, wherein aligning the elongate slot includes contacting a side wall of the case with the bracket and sliding the bracket vertically such that the hook feature engages the upright to limit movement of the bracket away from the upright.

5. The method of claim 1, wherein placing the refrigeration apparatus onto the shelf of the retail gondola includes positioning the case between a left upright and a right upright of the retail gondola such that the case nearly spans between the left upright and the right upright, wherein the bracket includes a plate and the hook feature extends rearwardly from the plate, and the method further comprises contacting at least one wall of the case with a respective bracket prior to inserting hook features of each bracket into a respective opening in the upright.

6. The method of claim 1, wherein inserting the hook feature of the bracket into the opening in the upright of the retail gondola is performed after placing the refrigeration apparatus onto the shelf of the retail gondola.

7. The method of claim 1, further comprising:

illuminating a refractive element on a window attached to a door of the case, wherein the refractive element when contacted by light from a light source in the door presents an image on the window indicative of a source of products located within the refrigeration apparatus.

8. The method of claim 1, wherein the refrigeration apparatus includes a decal on an inner rear wall thereof, and placing the refrigeration apparatus onto the shelf of the retail gondola includes positioning the case such that images on the decal align with at least one shelf in the case such that when the case is depleted of retail products the images on the decal provide an appearance that retail products are located with the case.

9. A refrigeration apparatus for mounting to a retail gondola comprising:

a case comprising a top wall, a bottom wall, a left wall, a right wall and a rear wall defining a forward opening and a storage compartment for storing retail items, the case further including a heat conductive inner wall and a heat conductive outer wall;

a door hingedly connected with the case, the door movable between a closed position for covering the forward opening and an open position for providing access to the storage compartment;

a compressor disposed within case;

a condenser coil disposed within the case adjacent the outer wall and in fluid communication with the compressor;

an evaporator coil disposed within the case adjacent the inner wall and in fluid communication with the compressor;

brackets connected with the case and extending rearwardly from the case away from the rear wall for engaging an upright of a retail gondola.

10. The refrigeration apparatus of claim 9, wherein each bracket includes hook features extending from a plate, wherein brackets on a same side of the case have upwardly extending hook features on one bracket and downwardly extending hook features on another bracket.

11. The refrigeration apparatus of claim 9, wherein each bracket includes an elongate slot elongated in a vertical direction, which is generally parallel with the rear wall.

12. The refrigeration apparatus of claim 11, further comprising a threaded fastener connecting the bracket with the case, wherein the case includes an opening configured to receive the threaded fastener and the elongate slot has a horizontal dimension configured to receive the threaded fastener for attaching the bracket to the case.

13. The refrigeration apparatus of claim 12, wherein a lowermost opening in the case for receiving the threaded fastener is disposed at or above a vertical midpoint of the left wall or the right wall.

14. The refrigeration apparatus of claim 9, further comprising a power cord electrically connected with the compressor and a support base connected with and contacting the bottom wall, wherein the support base is inwardly offset from the rear wall for defining a power cord channel for receiving the power cord.

15. The refrigeration apparatus of claim 14, wherein the power cord channel extends from the left side wall to the right side wall and is less than two inches in height.

16. The refrigeration apparatus of claim 9, wherein the door includes a frame, a window mounted to the frame, a linear light source mounted to the frame and reflective or refractive element on the window, wherein the light source and the element are positioned to cooperate such that light emanating from the light source contacts the element and is directed forwardly for presenting an image on the window.

17. The refrigeration apparatus of claim 16, wherein the linear light source includes a plurality of LEDs.

18. The refrigeration apparatus of claim 9, further comprising at least one shelf mounted to the case inside the storage compartment and a decal affixed to the inner wall on the rear wall of the case, wherein the decal includes at least one image of a product that is stored in the storage compartment and the at least one image is aligned so as to appear as the image is supported on the at least one shelf.

19. A refrigeration apparatus for mounting to a retail gondola comprising:

a case comprising a top wall, a bottom wall, a left wall, a right wall and a rear wall defining a forward opening and a storage compartment for storing retail items, the case further including a heat conductive inner wall and a heat conductive outer wall;

at least one shelf mounted to the case inside the storage compartment;

an image on the inner wall on the rear wall of the case, wherein the image depicts a product that is stored in the storage compartment and the image is aligned so as to appear as the image is supported on the at least one shelf;

a door hingedly connected with the case, the door being movable between a closed position for covering the forward opening and an open position for providing access to the storage compartment, the door including a frame, a window mounted to the frame, a light source mounted to the frame and reflective or refractive element on the window, wherein the light source and the element are positioned to cooperate such that light emanating from the light source contacts the element and is directed forwardly for presenting an image on the window;

a compressor disposed within case;

a condenser coil disposed within the case adjacent the outer wall and in fluid communication with the compressor;

an evaporator coil disposed within the case adjacent the inner wall and in fluid communication with the compressor;

brackets connected with the case and extending rearwardly from the case away from the rear wall for engaging an upright of a retail gondola.

* * * * *